US006797621B2

(12) United States Patent
Song et al.

(10) Patent No.: US 6,797,621 B2
(45) Date of Patent: Sep. 28, 2004

(54) ETCHANT COMPOSITION FOR MOLYBDENUM AND METHOD OF USING SAME

(75) Inventors: Hyung-Soo Song, Chonju-shi (KR); Ky-Sub Kim, Chonju-shi (KR); Min-Choon Park, Iksan-shi (KR); Sok-Joo Lee, Kumi-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 127 days.

(21) Appl. No.: 09/801,804

(22) Filed: Mar. 9, 2001

(65) Prior Publication Data

US 2001/0034139 A1 Oct. 25, 2001

(30) Foreign Application Priority Data

Mar. 20, 2000 (KR) ..... 2000-14088

(51) Int. Cl.[7] ..... H01L 21/302
(52) U.S. Cl. ..... 438/689; 438/745; 438/753
(58) Field of Search ..... 438/745, 747, 438/689, 753, 694, 906, 700, 704, 640; 216/13, 18, 48; 156/655.6, 643.6, 667

(56) References Cited

U.S. PATENT DOCUMENTS

| | | | | | |
|---|---|---|---|---|---|
| 4,220,706 | A | * | 9/1980 | Spak et al. | 430/318 |
| 4,462,861 | A | * | 7/1984 | McClean | 156/640 |
| 5,100,505 | A | * | 3/1992 | Cathey, Jr. | |
| 5,698,503 | A | * | 12/1997 | Ward et al. | 510/176 |
| 5,851,303 | A | * | 12/1998 | Hwang et al. | 134/3 |
| 6,127,908 | A | * | 10/2000 | Bozler et al. | 333/246 |
| 6,387,822 | B1 | * | 5/2002 | Murphy et al. | |

FOREIGN PATENT DOCUMENTS

| | | | |
|---|---|---|---|
| DE | 2425379 | * | 3/1975 |
| KR | 2001077228 A | * | 2/2000 |

* cited by examiner

*Primary Examiner*—Hsien Ming Lee
(74) *Attorney, Agent, or Firm*—McKenna Long & Aldridge, LLP

(57) ABSTRACT

An etchant composition for molybdenum includes: 5 to 20% by weight of hydrogen peroxide ($H_2O_2$); 75 to 94% by weight of water; and an additive including a pH controlling agent. The etching composition is particularly useful for the fabrication of semiconductor devices. Molybdenum may be etched from a substrate by applying the etchant composition, preferably by spraying or immersion, and preferably at a temperature range of 30° C. to 45° C.

11 Claims, 1 Drawing Sheet

ETCHANT COMPOSITION FOR MOLYBDENUM AND METHOD OF USING SAME

This application claims the benefit of Korean Patent Application No. 2000-14088, filed on Mar. 20, 2000, which is hereby incorporated by reference for all purposes as if fully set forth herein.

BACKGROUND OF THE INVENTION

1. Field of the Invention

The present invention relates to an etchant composition, and more particularly, to an etchant composition for molybdenum or a molybdenum-based alloy for use in a thin film transistor liquid crystal display device (TFT-LCD).

2. Discussion of the Related Art

A method of manufacturing an electrode line, such as gate, source and drain electrodes or the like for use in a semiconductor package such as a thin film transistor liquid crystal display (TFT-LCD) device, involves a depositing technique, a photolithography technique, and an etching technique.

The etching technique includes dry-etching and a wet-etching. The dry-etching further includes plasma dry-etching, ion beam milling etching, and reactive ion etching. In wet-etching, acids and other chemical solutions are used as an etchant. In chemical dry-etching, for example plasma dry-etching, plasma is used to generate gas radicals such as fluorine radicals in order to etch any portions of a thin film that are not covered by photoresist. In physical dry-etching, for example the ion beam milling etching, an ion beam is used in order to etch any portions of a thin film that are not covered by photoresist.

Meanwhile, metals suitable for use in an electrode line, for example gate, source, and drain electrodes, include Al, Al—Cu, Ti—W, Ti—N or the like. Particularly, Al or Al-based alloy is used as a metal for the source and drain electrodes. Each of such metal materials has chemically and electrically different properties and, therefore etchant compositions suitable for each of such metal materials differ. For example, a metal layer of Al or an Al-based alloy is etched using a plasma of $Cl_2$, $BCl_3$, $SF_6$, $CF_4$, or $CHF_3$, or using an etchant having a composition comprising phosphoric acid 72%, nitric acid 2%, acetic acid 10%, and water 16% at 40 to 50° C.

However, an etchant solution suitable for metal materials other than Al or an Al-based alloy has not been introduced yet. When the etchant for Al is used for metal materials other than Al or an Al-based alloy, a good taper profile can not be secured. Further, in the case of using plasma to dry-etch metal materials other than Al or an Al-based alloy, production costs increase.

The current semiconductor industrial field, such as the manufacture of TFT-LCDs, requires a fast process, low production costs, good electrical characteristics, and so molybdenum or molybdenum-based alloys have been a subject of much research to be used as a material for an electrode line, such as the source and drain electrode of the TFT, instead of using Cr, Al or an Al-based alloy (for example, Mo/Al—Nd or Mo/Al—Nd/Mo).

U.S. Pat. No. 5,693,983 discloses that molybdenum material, instead of Al, is used as source and drain electrodes for a TFT but only the dry-etching technique using plasma is suggested to etch the molybdenum layer.

U.S. Pat. No. 4,747,907 discloses an etchant solution comprising ferric cyanide or ferric sulfate, but the etchant solution comprising ferric cyanide and ferric sulfate has problems in that it is difficult to treat its liquid waste, and it is also difficult to obtain a taper angle sufficient to apply to a practical LCD manufacturing process.

SUMMARY OF THE INVENTION

Accordingly, the present invention is directed to an etchant composition for molybdenum that substantially obviates one or more of the problems due to limitations and disadvantages of the related art.

An object of the present invention is to provide an etchant solution suitable for molybdenum or a molybdenum-based alloy.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides an etchant composition for molybdenum for use in a semiconductor manufacturing process, including: 5 to 20% by weight of hydrogen peroxide ($H_2O_2$); 75 to 94% by weight of water; and an additive, including a pH controlling agent.

Preferably, the hydrogen peroxide is 8 to 18% by weight, and the additive including the pH controlling agent is selected from a group consisting of ammonium sulfate, ammonium nitrate, sodium dihydrogen citrate/disodium hydrogen citrate, disodium hydrogen phosphate/trisodium citrate, or ammonium acetate.

The molybdenum layer etched by the inventive etchant solution exhibits excellent properties in taper profile, etching uniformity, etching rate as well as under-cut.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
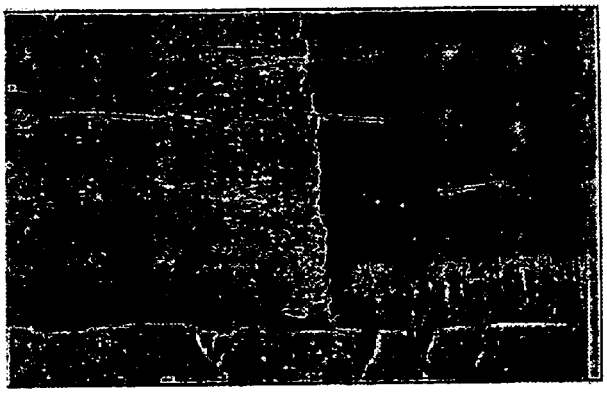
(Related Art) FIG. 1
FIG. 1 is a scanning electron microscope (SEM) photograph illustrating a taper profile of a molybdenum layer etched by an etchant solution for Al.

Reference will now be made in detail to the preferred embodiment of the present invention, an example of which is illustrated in the accompanying drawings.

An etchant composition, according to a preferred embodiment of the present invention, contains 5 to 20% by weight of hydrogen peroxide ($H_2O_2$), 75 to 94% by weight of water, and 1 to 5% by weight of additives. Preferably, the etchant solution contains 8 to 16% by weight of hydrogen peroxide ($H_2O_2$). An etchant solution containing Fe(III) requires a liquid waste treatment facility and, therefore is expensive. However, hydrogen peroxide ($H_2O_2$) can be easily treated and, thus is inexpensive. It is preferred that high purity hydrogen peroxide and water be used in a semiconductor process, and such materials which are on the market, or are purified according to a well-known industrial criterion, are also available. Water for a semiconductor process is ultra pure water and its preferred resistance is greater than 15 mΩ/cm.

The additives include a pH-controlling agent to activate an etching action of hydrogen peroxide, for example, sodium dihydrogen citrate/disodium hydrogen citrate, disodium hydrogen phosphate/trisodium citrate, or ammonium acetate. The additives preferably also include those which are typically used for an etchant solution, for example, surfactants or metal corrosion inhibiting agents. The surfactants are added to lower the surface tension for improved etching uniformity. A cation surfactant, an anion surfactant, and a non-ion surfactant are all usable as the additive, if they endure the etching solution and are economical. In the preferred embodiments, a fluorine-based surfactant is used as the additive.

The etching process using the inventive etchant solution is performed by a well-known method in the art, for example, by immersing a molybdenum-bearing substrate with the etchant, or by spraying the etchant onto the substrate. The temperature during the etching process is 20° C. to 50° C., preferably 30° C. to 45° C., and an appropriate temperature depends on process conditions and the process requirement.

The etching time of a molybdenum layer using the inventive etchant solution depends on the thickness of the molybdenum layer or the etching temperature, and is generally seconds to minutes. The etching temperature and etching time described above are conditionally decided by those skilled in the art without departing from the spirit and scope of the invention.

The inventive etchant solution for molybdenum containing hydrogen peroxide has a taper angle as good as 40° to 60° and an etching rate of 1000 Å/min, which is appropriate to a semiconductor fabrication process such as the TFT-LCD.

The inventive etchant composition will be explained in more detail hereinafter.

The taper profile of etched molybdenum can be examined using a HITACHI.RTM. S-4200 SEM (scanning electron microscope). Its result will be remarked as follows:

■: Excellent—The taper profile is excellent (the taper angle of 40° to 60°), and the etching rate and etching uniformity are excellent.

●: Medium—The taper profile is good, but the taper angle is less than 40°.

X: Bad—The taper profile is bad.

EXAMPLE 1

The etchant solution contains 9% by weight of hydrogen peroxide ($H_2O_2$), 90% by weight of ultra pure water, and 1% of weight of an additive (ammonium acetate). A glass substrate bearing a molybdenum layer and an etch resist pattern is contacted either by immersion or by spraying with the etchant solution. The molybdenum dissolution rate of the etchant solution when operated at a temperature of 40° is 1000 Å/min. The taper profile is excellent, and the taper angle is also excellent, as good as 40 to 60°. Also, an under-cut does not occur.

Figure 3:
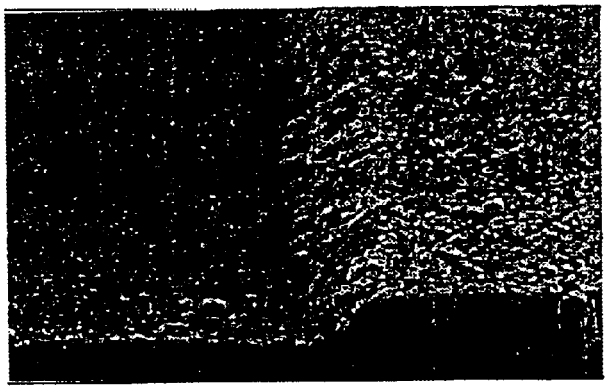
FIG. 3 is a SEM photograph illustrating a taper profile of a molybdenum layer etched by an etchant solution according to a preferred embodiment of the present invention.

FIG. 3 is a SEM photograph illustrating the taper profile of a molybdenum layer etched by the etchant solution of Example 1. The result of the etching test is shown in Table 1.

EXAMPLES 2–7

The etchant solution contains hydrogen peroxide ($H_2O_2$), ultra pure water, and an additive (for example, ammonium nitrate or ammonium sulfate) in the ratios shown in Table 1. After the etching test, the taper profile of the etched molybdenum layer is examined using the SEM. The results of the etching tests are shown in Table 1.

TABLE 1

| Example No. | Composition (wt. %) $H_2O_2$/water/additive | Taper profile |
|---|---|---|
| 1 | 9/90/1 | ■ etching rate - excellent |
| 2 | 9/88/3 | ■ etching rate - excellent |
| 3 | 12/87/1 | ■ etching rate - excellent |
| 4 | 15/84/1 | ■ etching rate - excellent |
| 5 | 15/80/5 | ■ etching rate - excellent |
| 6 | 20/79/1 | ● taper angle - <40° |
| 7 | 20/76/4 | ● taper angle - <40° |

Comparison Example 1

The etchant solution contains 5% by weight of hydrogen peroxide ($H_2O_2$) and 95% by weight of ultra pure water. An additive is not added. After the etching test, the taper profile of the etched molybdenum layer is examined using the SEM. The result of the etching test is shown in Table 2.

TABLE 2

| Comparison Example No. | Composition (wt. %) $H_2O_2$/water/additive | Taper profile |
|---|---|---|
| 1 | 5/95/0 | X etching uniformity - bad |

Comparison Examples 2–4

An etchant solution for Al or an Al-based alloy contains phosphoric acid ($H_3PO_4$), nitric acid ($HNO_3$), acetic acid ($CH_3CO_2H$), and an additive (0.005% by weight of a fluorine-based surfactant). Also, water is added and diluted to prepare the etchant composition of 100 wt. %. In the same way as Examples 1–7, the etching test is performed and the taper profile is examined using the SEM. It is impossible to control the etching time within ten seconds, and the taper profile is bad. The results of the etching test are shown in Table 3. FIG. 1 is a SEM photograph illustrating a taper profile of molybdenum layer etched by an etchant solution for Al.

TABLE 3

| Comparison Example No. | Composition (wt. %)* $H_3PO_4$/$HNO_3$/$CH_3CO_2H$ | Taper profile |
|---|---|---|
| 2 | 72/2/10 | X etching rate - not controlled |
| 3 | 67/5/10 | X etching rate - not controlled |
| 4 | 68/8/10 | X etching rate - not controlled |

TABLE 3-continued

| Comparison Example No. | Composition (wt. %)* $H_3PO_4/HNO_3/CH_3CO_2H$ | Taper profile |
|---|---|---|

*Water is added and diluted for the etchant composition to be 100 wt. %.

Comparison Examples 5–7

Figure 2:
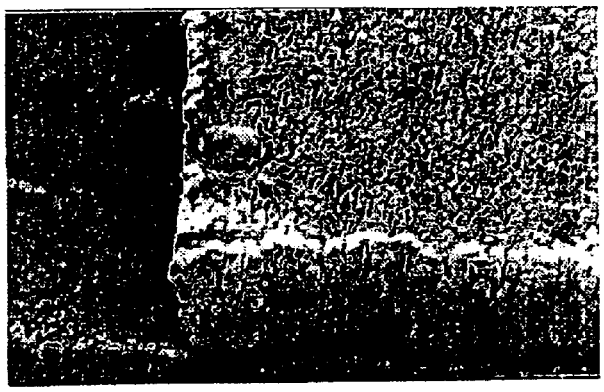
(Related Art) FIG. 2
FIG. 2 is a SEM photograph illustrating a taper profile of a molybdenum layer etched by an etchant solution containing $K_3Fe(CN)_6$.

An etchant solution which is disclosed in U.S. Pat. No. 4,747,907 contains $K_3Fe(CN)_6$. $Na_2MoO_4$, and $H_3PO_4$. Also, water is added and diluted to prepare the etchant composition of 100 wt. %, while an additive is not added. In the same way as Examples 1–7, the etching test is performed and the taper profile is examined using the SEM. It is impossible to control the etching time within ten seconds, and the taper profile is bad. The results of the etching test are shown in Table 4. FIG. 2 is a SEM photograph illustrating a taper profile of molybdenum layer etched by an etchant solution containing $K_3Fe(CN)_6$.

TABLE 4

| Comparison Example No. | Composition (wt. %)* $K_3Fe(CN)_6/Na_2MoO_4/H_3PO_4$ | Taper profile |
|---|---|---|
| 5 | 11.5/9.5/0.8 | X under-cut occurs |
| 6 | 11/9/0 | X under-cut occurs |
| 7 | 74/2/7/0.02 | X under-cut occurs |

*Water is added and diluted for the etchant composition to be 100 wt. %.

As seen in Tables 1 to 4 above, the molybdenum layer etched by the inventive etchant solution exhibits excellent properties in taper profile, etching uniformity, etching rate as well as under-cut.

It will be apparent to those skilled in the art that various modifications and variation can be made in the present invention without departing from the spirit or scope of the invention. Thus, it is intended that the present invention covers the modifications and variations of this invention provided they come within the scope of the appended claims and their equivalents.

What is claimed is:

1. A method of etching molybdenum on a substrate, comprising:

preparing a solution comprising 5 to 20% by weight of hydrogen peroxide ($H_2O_2$), 75 to 94% by weight of water, and an additive activating an etching action of the hydrogen peroxide; and applying the solution to etch the molybdenum on the substrate.

2. The method of claim 1, wherein applying the solution to the substrate comprises spraying the solution onto the substrate.

3. The method of claim 1, wherein applying the solution to the substrate comprises immersing the substrate into the solution.

4. The method of claim 1, wherein the solution is applied to the substrate at a temperature of between 20° C. to 50° C.

5. The method of claim 1, wherein the solution is applied to the substrate at a temperature of between 30° C. to 45° C.

6. The method of claim 1, wherein the additive includes one of sodium dihydrogen citrate/disodium citrate, disodium hydrogen phosphate/trisodium citrate, and ammonium acetate.

7. The method of claim 1, wherein the additive include one of surfactants and metal corrosion inhibiting agents.

8. The method of claim 1, wherein the water has a resistance greater than about 15 mΩ/cm.

9. The method of claim 1, wherein the solution contains about 8 to 16% by weight of hydrogen peroxide ($H_2O_2$).

10. The method of claim 1, wherein an etching rate of the solution is about 1000 Å/min.

11. The method of claim 1, wherein the additive includes a pH controlling agent.

* * * * *

UNITED STATES PATENT AND TRADEMARK OFFICE

CERTIFICATE OF CORRECTION

PATENT NO. : 6,797,621 B2
APPLICATION NO. : 09/801804
DATED : September 28, 2004
INVENTOR(S) : Hyung-Soo Song It is certified that error appears in the above-identified patent and that said Letters Patent is hereby corrected as shown below:

On the title Page, should read

Item (73) LG.Philips LCD Co., Ltd. and Dongwoo Fine-Chem Co., Ltd.

Signed and Sealed this
First Day of March, 2011

David J. Kappos

David J. Kappos
*Director of the United States Patent and Trademark Office*